United States Patent [19]

Spaller, Jr.

[11] 3,953,315

[45] Apr. 27, 1976

[54] ELECTROLYTIC CELL CONSTRUCTION

[75] Inventor: Albert Edward Spaller, Jr., Johnson City, Tenn.

[73] Assignee: Eastman Kodak Company, Rochester, N.Y.

[22] Filed: Dec. 23, 1974

[21] Appl. No.: 536,046

[52] U.S. Cl. ..... 204/272; 204/279; 204/297 R

[51] Int. Cl.[2] ..... C25B 11/02; C25B 9/00; C25B 9/02

[58] Field of Search ..... 204/78, 260, 272, 279, 204/297 R

[56] References Cited

UNITED STATES PATENTS 820,113 5/1906 Hinkson ..... 204/272 X 3,481,857 12/1969 Gray ..... 204/272

FOREIGN PATENTS OR APPLICATIONS 1,104,078 2/1968 United Kingdom ..... 204/272

*Primary Examiner*—John H. Mack
*Assistant Examiner*—A. C. Prescott
*Attorney, Agent, or Firm*—J. Frederick Thomsen; Daniel B. Reece, III

[57] ABSTRACT

An electrolytic cell useful in the oxidation of organic compounds is disclosed. The cell is provided with a unique device for centering or aligning the anode and cathode to provide even current distribution over the cylindrical surfaces thereof, thereby eliminating or substantially reducing areas of low current density which may cause tar formation, power losses, and undesirable reactions of oxidized products.

2 Claims, 3 Drawing Figures

ELECTROLYTIC CELL CONSTRUCTION

This invention relates generally to electrochemical oxidation processes and more specifically this invention relates to improved electrolytic cell construction for the oxidation of organic compounds.

The electrolytic oxidation of organic compounds is well known in the art. For example, U.S. Pat. No. 3,509,031 teaches the preparation of hydroquinone by electrolyzing an aqueous solution of phenol. Other well known electrolytic oxidation processes include oxidation of benzene to p-benzoquinone, such as disclosed in Belgium Pat. No. 777,905. Numerous other electrolytic oxidation processes are known in the art.

The electrolytic cell constructed in accordance with this invention is useful in electrolytic processes where even current distribution over the electrodes is important. Tar formation may occur in organic reactions where the space between electrodes is relatively large. Conventional electrolytic cells include a hollow, cylindrical cathode and a cylindrical anode of smaller diameter than the inside diameter of the cathode. The cell is assembled by placing the anode inside the cathode from one end and coaxially aligning the anode and cathode to thereby provide an annular space between the anode and cathode for passage of material to be oxidized. The anode and cathode must, of course, be insulated from each other and must be capable of accurate coaxial alignment to insure even current distribution while still allowing for even flow through the annular passage. Accurate coaxial alignment of the anode and cathode prevents areas of low current density which in turn cause tar formation and accumulation in some processes, power losses and undesirable side reactions resulting in decreased current efficiency of the cell.

The electrolytic cell according to this invention is an improvement over conventional cells of the past wherein threaded plastic centering screws extending radially through the walls of the cathode at intervals around its circumference and contacting the anode have been used. By selectively turning the centering screws in or out, the anode could be centered inside the cathode. This technique of the prior art provides no visual way to determine the position of the anode within the cathode, resulting in the possibility of the anode not being axially aligned within the cathode. Also, the centering screws are difficult to seal against leaks of the electrolyte around the threads through the cathode wall. Another disadvantage of centering screws is that conductive solids from the electrolyte tends to plate out around the plastic plugs which eventually will cause a short between the anode and cathode.

The higher electrical efficiency realized using this process results in a lower cost per pound of product produced in the process, thereby allowing one to economically achieve higher concentrations of oxidized compound in the product stream, thus reducing the capital requirements for a plant.

This invention is especially important with respect to the electrochemical oxidation of phenol to hydroquinone, including the electrochemical oxidation of substituted phenols such as o-cresol to corresponding substituted hydroquinone.

The term "phenol", as used herein, is intended to include alkyl-substituted phenols wherein the alkyl groups contain 1 to 4 carbon atoms and are positioned ortho or meta to the hydroxyl group, and the term "hydroquinone", as used herein, is intended to include alkyl-substituted hydroquinones wherein the alkyl group has a carbon content of 1 to 4 carbon atoms.

It is therefore an object of this invention to provide an improved electrolyte cell construction.

It is another object of this invention to provide an improved electrolytic cell for the electrolytic oxidation of organic compounds wherein electrical current efficiency is substantially improved by accurate alignment of the anode and cathode.

It is a further object of this invention to provide an improved electrolytic cell for the electrochemical oxidation of phenol to hydroquinone wherein good yields of hydroquinone are obtained.

According to the present invention, an electrolytic cell is provided which is especially suitable for the oxidation of aromatic compounds, particularly oxidation of phenol to hydroquinone. For example, U.S. Pat. No. 3,509,031 discloses a process for oxidizing phenol to hydroquinone or benzoquinone at high chemical and electrical efficiencies by electrolyzing aqueous solutions of phenol at temperatures of 25° to about 100°C., a pH of less than about 4 at a current density of 4 to about 100 amperes/dm.$^2$ until up to about 80% by weight of the phenol has been electrolyzed. This patent points out that an undivided cell provides hydroquinone as the main product of the electrolysis of phenol.

The present invention provides an electrolytic cell which is especially useful in producing hydroquinone in accordance with the process described in this patent, i.e., in an undivided cell.

Figure 1:
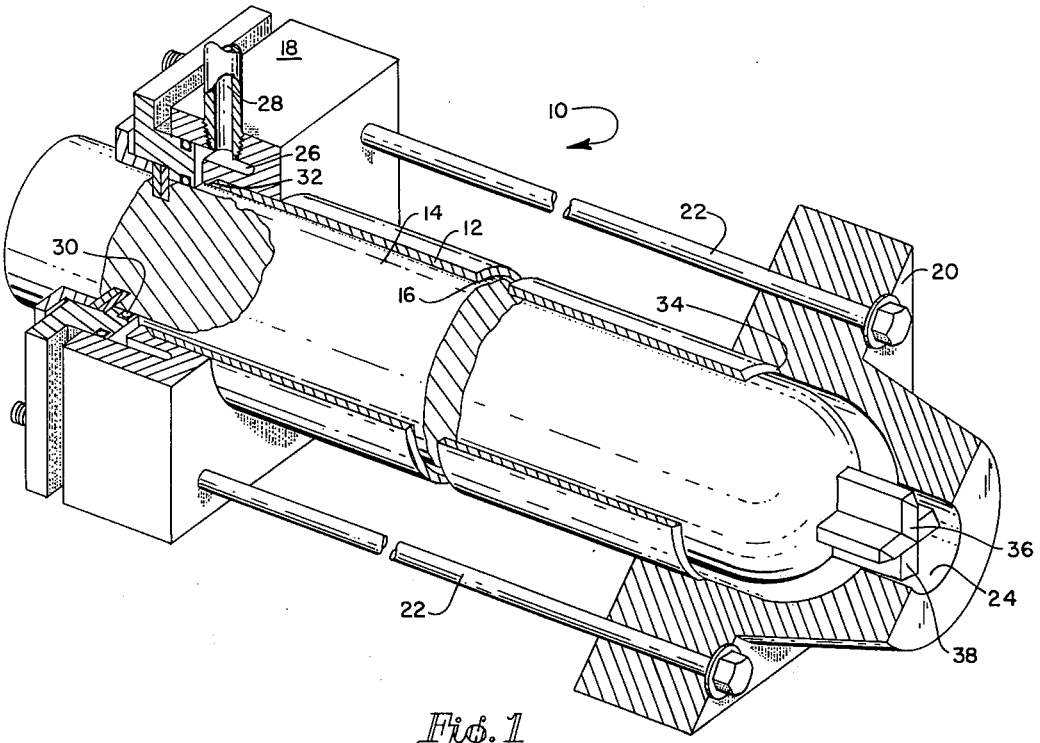
FIG. 1 is a perspective view, partially in section, of the electrolytic cell constructed in accordance with this invention.
Figure 2:
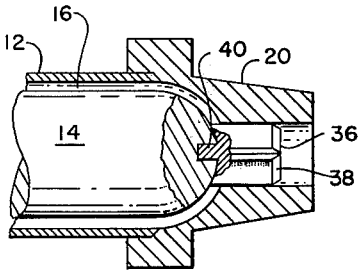
FIG. 2 is a cross-section view of the end of the electrolytic cell along line 2,2 of FIG. 3.
Figure 3:
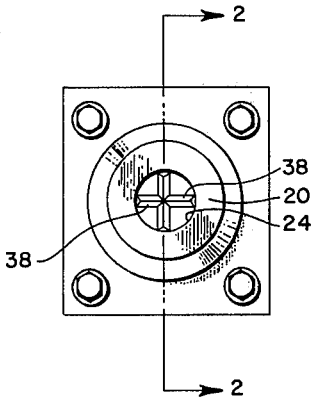
FIG. 3 is an enlarged end view of the electrolytic cell showing the centering device according to this invention.

Referring now to the drawings, electrolytic cell 10 includes a hollow, cylindrical cathode 12 and a smaller cylindrical anode 14 positioned inside cathode 12 in coaxial alignment so as to define an annular passage 16 for flow of the compound to be oxidized. End members 18 and 20 are fabricated from an insulating material and serve as seals and structural members. End members 18 and 20 are maintained in position by means of tie rods 22. The material to be oxidized flows into inlet 24 from a supply source (not shown), down the annular passage 16, into circular manifold 26 in end member 18 and exits through outlet 28. Anode 14 extends beyond end member 18 which supports this end of the anode. A seal between end member 18 and anode 14 is provided by means of O-ring 30. Seals between the cathode 12 and end members 18 and 20 are along contacting surfaces 32 and 34 respectively.

According to this invention, inlet opening 24 which is coaxial with the electrodes, serves a dual function. Besides allowing for entrance of the material to be oxidized, it supports centering device 36 which is fixed to anode 14. As the anode is positioned inside the cathode, centering device 36 is inserted and snugly fitted inside opening 24 to hold the anode and cathode in alignment, thereby insuring that the width of the annular passage 16 is uniform throughout its entire length.

The opening 24 is symmetrical with the axis of the anode and cathode and is of size which will accommodate the desired flow rate of material to be oxidized.

Centering device 36 is firmly fixed to the end of anode 14 and is of a size and shape to be snugly fitted into opening 24. The centering device 36 is designed to allow flow through opening 24. Most conveniently, centering device 36 comprises angularly spaced and radially extending blades 38, the edges of which snugly engage the inner surface of opening 24. Thus, when the centering device 36 is so engaged with end member 20 at opening 24, the electrode is accurately aligned and flow is allowed through the centering device between the blades 38.

Centering device 36 is firmly affixed to the end of anode 14 by any suitable means, such as by cement. Centering device is fabricated from an insulating material such as plastic (e.g., polypropylene), and may be provided with an adapter 40 for mating with an opening in the end of anode 14.

The cathode 12 and anode 14 are connected to a source of D.C. electricity by suitable connectors (not shown). The cathode 12 and anode 14 may be fabricated from conventional materials known to those skilled in the art. As to the choice of anode materials, any metal which is stable in the electrolyte or which passivates under the electrolysis condition may be used, such as, for example, platinum, gold, graphite, manganese, chromium, iron, nickel, lead, and alloys thereof and the like. Lead dioxide is preferred as the anode material for oxidation of phenol to p-benzoquinone. As the cathode material, any metal which is stable to the electrolysis conditions described in the present invention may be employed as the cathode in the present invention. Suitable cathode materials include such metals as steel, lead, tin, cadmium, copper, nickel, and the like. Of course, it is to be understood that the list of these materials mentioned as being useful as anodes and cathodes is not exclusive and any of the metals which meet the above qualifications may be used if desired.

The insulating end members 18 and 20 may be fabricated from suitable materials such as, for example, plastic. Polypropylene is suitable for this purpose.

It is recognized in the art, for example in U.S. Pat. No. 3,509,031, that high current densities are desirable from several standpoints, including lessening tar formation on the anode. Tar tends to form and build up on lead dioxide anodes in areas of low current density. It is recognized in the art that tar formation on the anode is responsible for reducing electrical efficiency as the electrolysis proceeds. In a cell having non-uniform spacing of electrodes, the current density will be inversely proportional to the distance between the anode and cathode. In the preferred type of anode having a rounded end and no corresponding cathode area close by, the current density will be much less than over the outer cylindrical surface which is closely positioned to the inner cylindrical surface of the cathode, or, in other words, the "straightaway" position. Thus, undesirable tar formation and build up has been found to occur in operation of such cells at the terminal rounded end of the anode.

Operation of the electrolytic cell will now be described with reference to the oxidation of phenol to hydroquinone.

The electrolytic cell constructed in accordance with this invention is used according to conventional techniques. For example, one suitable process is disclosed in the aforementioned U.S. Pat. No. 3,509,031.

The concentration of phenol in aqueous solution being electrolyzed is limited to an upper limit of about 4 percent by weight, and a lower practical limit of about 0.5 percent by weight. Although the concentration of phenol in the aqueous solution can be as high as about 4 percent by weight, about 3 percent is preferred. Above 4 percent phenol concentration, conversion efficiency drops, the remainder appearing as tars or low molecular weight condensation products which adhere to the electrode surface. Conventional co-solvents may be used.

When this invention is practiced in the preferred continuous process, temperatures of about 25° to 100°C. can be used. It is preferred to operate continuously in the range of about 30° to 80°C., with the range of about 40°–70°C. being more preferred.

The concentration of phenol in aqueous solution being electrolyzed is limited to an upper limit of about 4 percent by weight, and a lower practical limit of about 0.5 percent by weight. Although the concentration of phenol in the aqueous solution can be as high as about 4 percent by weight, about 1 to about 3 percent is preferred. Above 4 percent phenol concentration, conversion efficiency drops, the remainder appearing as tars or low molecular weight condensation products which adhere to the electrode surface. Conventional cosolvents may be used. Tar formation as mentioned before is responsible to some extent in reducing electrical efficiency as the electrolysis proceeds. It is preferred not to exceed a hydroquinone-quinone concentration of about 3% by weight.

The concentration of electrolyte is not narrowly critical, but it is preferred to operate in the range of about 1 to 5 percent by weight when the electrolyte is an inorganic acid. This range is preferred because of the relatively minor variations in electrical efficiency over this range as well as having sufficient conductivity to allow high current densities without excessive heating from power dissipation in a well designed cell. When the electrolyte consists of a mixture of an inorganic acid and an ionizable salt, the salt concentration can range from about 1 to 10 percent by weight, or 1 to 20 percent by weight and even as high as about 30 percent by weight. Although concentrations below 1 percent may also be used, the reaction is markedly slower.

Suitable electrolytes comprise any materials which ionize readily in water at a pH of 4 or less and preferably 2 or less and do not interfere with the phenol electrolysis. Specific examples include inorganic acids, such as sulfuric acid, phosphoric acid and the like; inorganic salts such as sodium sulfate, sodium bisulfate, potassium sulfate, potassium bisulfate, lithium sulfate, lithium bisulfate, sodium phosphate and the like, in conjunction with sufficient inorganic acid to maintain a pH of 4 or less; and organic salts such as sodium acetate, potassium acetate, lithium acetate, and the like, in a solution acidified to a pH of 4 or less.

In order to maintain optimum anode efficiency, at the low end of the current density range specified, one may clean the electrodes by immersion in a hydrocarbon tar solvent, as for example, ketones such as acetone, alcohols such as ethanol, or aromatic hydrocarbons such as benzene, toluene, and the like. This can be done by a rinsing operation in which the electrodes are left intact mounted in the electrolytic cell. In the most preferred ranges of current density, later defined, this cleaning operation is not required.

An important variable of the present process is the anode potential. This value has a minimum below which oxidation of phenol by electrolysis will not occur. This value is approximately +0.9 volt with respect to a saturated calomel electrode as measured by standard voltammetric techniques. It is preferred to employ an anode potential of about +0.9 to +3.5 volts with a range of +1.8 to +3.0 volts being more preferred. The cathode potential should be less than about +0.4 volt.

For the same considerations, the current density is also important since, for a given system, the electrode potential is usually a single-valued function of the current density. The electrode potential may therefore be controlled by adjusting the current density. Also, since the conversion rate per unit area of electrode surface is determined as much by the current density as by the electrical efficiency, it is desirable to operate at high current densities. The preferred range of current densities for the oxidation of phenol by electrolysis is about 4 to 100 amperes/dm.$^2$ with about 20 to about 60 being especially preferred. It is not practical to operate below 4 amperes/dm.$^2$ because of tar formation on the anode which lowers the efficiency of the phenol electrolysis to a point where the oxidative process is no longer commercially feasible. The use of high current densities in the practice of this process carries with it the added economic advantage of reducing the number of cells required for the electrolytic oxidation of phenol.

The degree of conversion to which the phenol substrate is subjected is important. For example, after about 50 percent conversion of phenol to hydroquinone by electrolysis, the overall electrical efficiency begins to drop. Approximately 80 percent was therefore determined as the upper practical limit of conversion of phenol. The formation of side products becomes more appreciable above the 80 percent phenol conversion level and aside from the depreciation in yield, conversion beyond this point is undesirable because of tar sticking to the electrode surface which results in reduction in the rate of diffusion of phenol to the anode.

The product stream can be continuously extracted with a low boiling, water-immiscible solvent, such as diethyl ether, in which the organic materials are soluble. The ether stream can be then fed into a vessel containing a higher boiling solvent in which both phenol and p-benzoquinone are soluble but in which hydroquinone is quite insoluble, such as, carbon tetrachloride. The ether is recycled and the hydroquinone filtered from the carbon tetrachloride solution and subsequently recrystallized in conventional apparatus. The carbon tetrachloride filtrate which contains traces of p-benzoquinone, as well as unreacted phenol, can be re-extracted with the aqueous phase from the first extraction and reused. The aqueous phase can then be returned to the electrolysis cell after appropriate replenishment with phenol.

Pressure is not critical and, while it is preferred to use atmospheric pressure for convenience, superatmospheric as well as subatmospheric pressures may be employed if desired.

Although the invention has been described in considerable detail with particular reference to certain preferred embodiments thereof, variations and modifications can be effected within the spirit and scope of the invention.

I claim:

1. In an electrolytic call wherein an aromatic compound is oxidized as it is caused to flow through the cell, said cell havig a hollow, cylindrical cathode and a smaller cylindrical anode positioned inside of and substantially coaxial with said cathode defining an annular passage for flow of said aromatic compound between the electrodes, and a pair of openings in said cathode for feed and discharge of said aromatic compound, the improvement which comprises a member fabricated from electrical insulating material axially aligned with and firmly affixed to the end of said anode and extending into firm engagement with an opening in the end of said cell axially aligned with said cathode to maintain said electrodes in alignment during operation of said cell.

2. In an electrolytic cell according to claim 1, the improvement wherein said plastic member is polypropylene.

* * * * *